US006018640A

United States Patent [19]

Blackman et al.

[11] Patent Number: 6,018,640

[45] Date of Patent: Jan. 25, 2000

[54] IMAGE ALIGNMENT DURING DUPLEX PRINTING

[75] Inventors: Jeffrey R. Blackman, Vancouver; Thomas W. Ruhe, La Center, both of Wash.

[73] Assignee: Hewlett-Packard Company, Palo Alto, Calif.

[21] Appl. No.: 09/283,824

[22] Filed: Mar. 31, 1999

[51] Int. Cl.[7] ..... G03G 15/00

[52] U.S. Cl. ..... 399/364; 399/13; 399/110

[58] Field of Search ..... 399/13, 38, 76, 399/82, 85, 107, 110, 364, 374, 401; 271/186, 225, 902; 101/229, 230, 231; 400/636

[56] References Cited

U.S. PATENT DOCUMENTS

| | | | |
|---|---|---|---|
| 3,972,612 | 8/1976 | Komori et al. | 355/26 |
| 4,607,948 | 8/1986 | Naito | 355/24 |
| 4,674,857 | 6/1987 | Satomura et al. | 399/306 |
| 4,777,498 | 10/1988 | Kasamura et al. | 399/401 |
| 4,787,616 | 11/1988 | Sasaki et al. | 271/3.03 |
| 4,788,575 | 11/1988 | Ito et al. | 399/13 |
| 4,845,528 | 7/1989 | Aoki et al. | 399/85 |
| 5,384,619 | 1/1995 | Yokomizo et al. | 399/364 X |
| 5,481,354 | 1/1996 | Nakajima | 399/374 X |
| 5,600,429 | 2/1997 | Kutsuwada | 399/374 X |
| 5,638,181 | 6/1997 | Kubo et al. | 399/364 X |
| 5,790,924 | 8/1998 | Creutzmann et al. | 399/110 |
| 5,836,706 | 11/1998 | Ruhe | 400/636 |
| 5,839,032 | 11/1998 | Yasui et al. | 399/110 X |

OTHER PUBLICATIONS

Hewlett Packard, "LaserJet 4000T Engine with Duplexer Unit," 6 pages; Disclosed Oct. 1997.

*Primary Examiner*—Sophia S. Chen

[57] ABSTRACT

During first side printing a media sheet is fed along a first media path from feed rollers to metering rollers and into a print zone. After first side printing, the metering roller stops prior to releasing the media sheet into the output tray. The metering roller reverses direction to move the media sheet back along the first media path onto the feed roller, and into the modular duplex handling system. The media sheet is flipped, then fed back for second side printing. Second side printing is performed in either one of book mode or tablet mode. In book mode, the top of the page is the same edge of the media sheet for the first side and the second side. In tablet mode, the media sheet edge at the top of the first side corresponds to the bottom of the second side.

9 Claims, 6 Drawing Sheets

FIG. 4
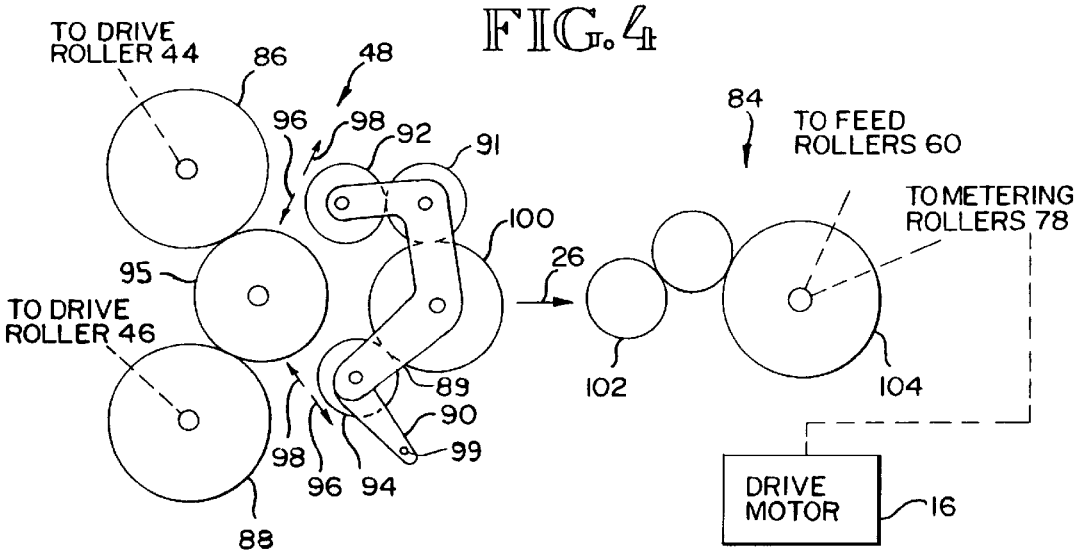
FIG. 5
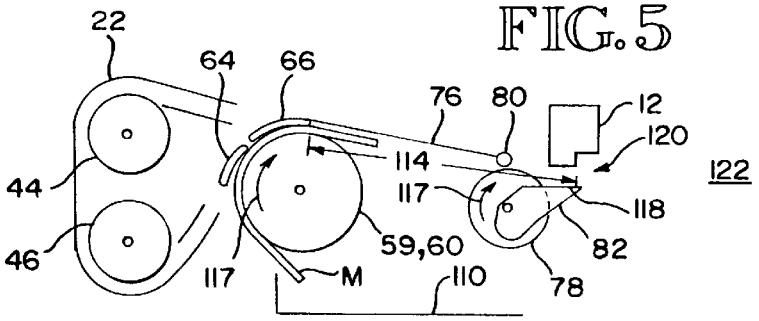
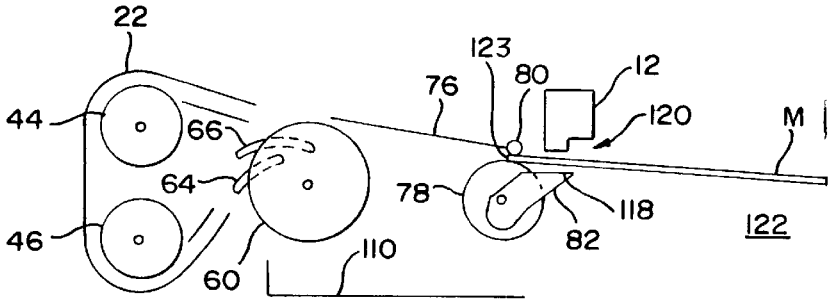
FIG. 6

FIG. 11
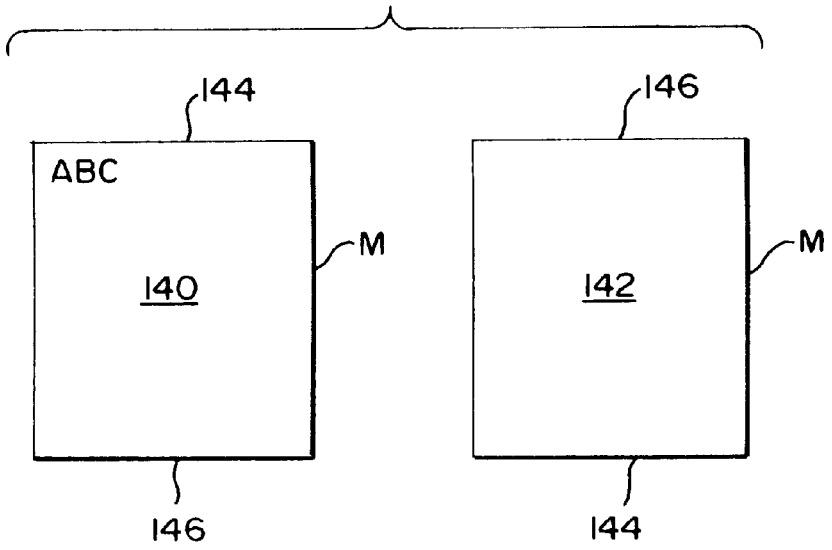
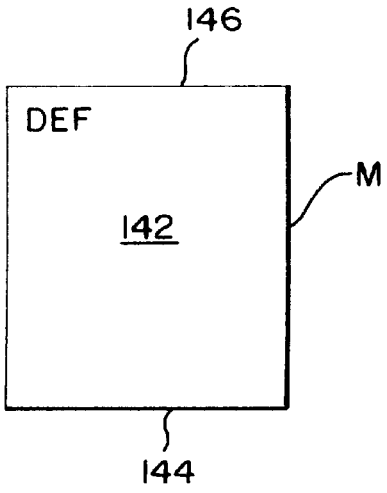
FIG. 12
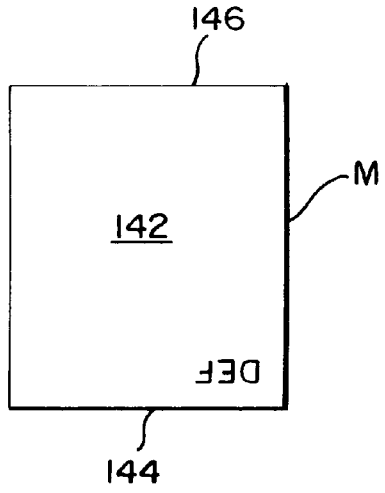
FIG. 13

FIG. 14
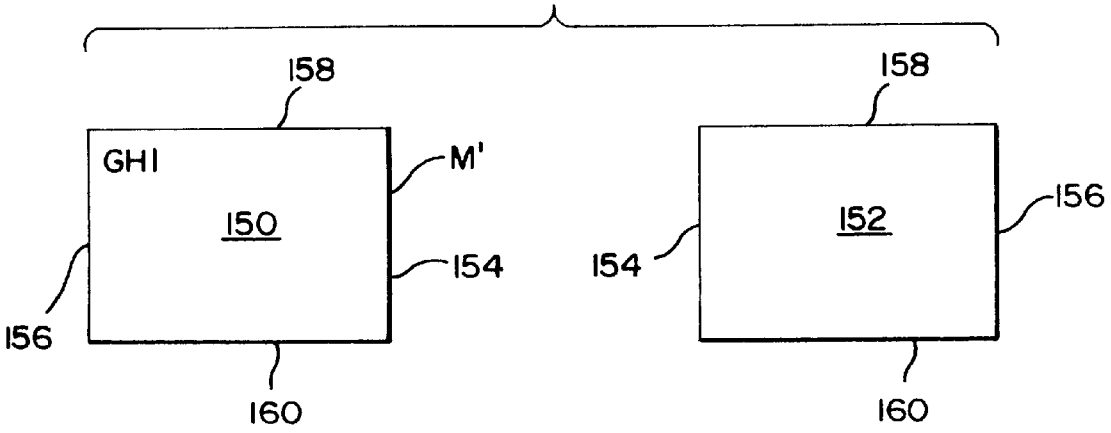
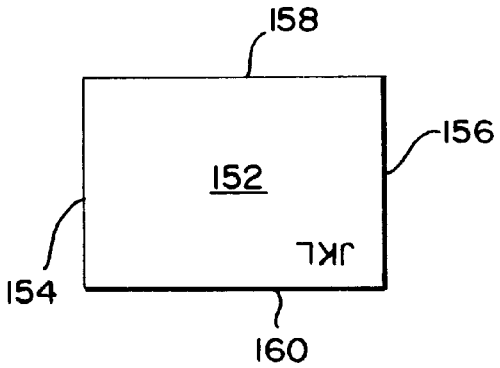
FIG. 15
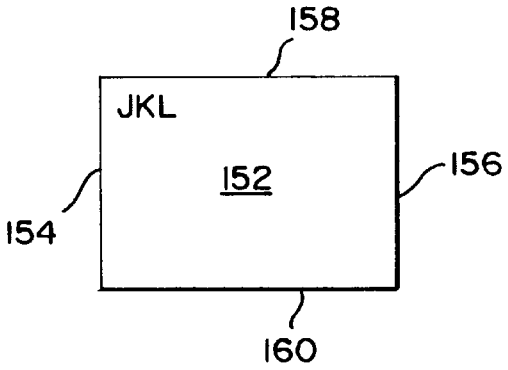
FIG. 16

IMAGE ALIGNMENT DURING DUPLEX PRINTING

BACKGROUND OF THE INVENTION

This invention relates generally to methods and apparatus for printing on two sides of a media sheet, and more particularly, to a media handling system which first feeds a media sheet with a first side exposed to a print source, then feeds the media sheet with a second side exposed to the print source.

Printing to two sides of a media sheet, referred to as duplex printing, is a desirable feature in printing systems. The advantages of duplex printing include reducing the amount of paper required compared to one-sided (simplex) printing, and generating print sets with layouts resembling that of professionally printed books. Conventional duplex printing devices employ complex paper handling mechanisms. Typically, an extra tray is used for temporary storage of pages having printing on a first side. In an alternative approach a second paper path is provided to route a first printed page around the existing paper supply.

Similarly, duplex copying typically is accomplished by either one of two methods. In one method, first side copies are stacked in a duplex tray. When a set of first side copies is complete, the copies are fed out of the duplex tray and returned with an odd number of inversions along a duplex path to receive second side imaging. In an alternative method first side copies are returned directly to receive second side imaging without stacking.

Conventional devices tend to have long paper paths and many parts. A substantial challenge with systems having these complex duplex printing paper paths is handling paper jams. Accordingly, there is a need for a simplified method and apparatus for duplex media handling at a desktop print recording device. Further, there is a need for orienting an image on a proper side of a media sheet for coated paper, letterhead and other stock in which one side differs from the other.

SUMMARY OF THE INVENTION

According to the invention, a modular duplex media handling system is used in conjunction with a simplex media handling print recording apparatus. The simplex media handling system includes firmware for operating either in a simplex mode or in a duplex mode, (where the modular duplex media handling system is installed to operate in duplex mode).

A print recording system includes the simplex media handling system and a recording print source. The simplex media handling system includes feed rollers and metering rollers. A media sheet is fed from an input tray along a first media path from the feed rollers to the metering rollers, onward into a print zone adjacent to the print recording source. The media sheet is fed through the print zone into an output tray.

During duplex operations, the metering roller stops prior to releasing the media sheet into the output tray. While the metering roller still engages a trailing edge of the media sheet, the metering roller reverses direction to move the media sheet back along the first media path onto the feed roller. According to another aspect of the invention, the feed roller, rotating with the metering rollers in the reverse direction, moves the media sheet into the modular duplex handling system. The media sheet is flipped by the modular duplex handling system, which feeds the media sheet back to the feed roller. The feed roller rotating once again in the forward direction moves the flipped media sheet along the first paper path to the metering roller and into the print zone for second side printing. The flipped media sheet is fed through the print zone and released into the output tray.

According to another aspect of the invention, software (e.g., firmware in a print controller; software in a host computing system) enables second side printing in either one of book mode or tablet mode for either a portrait layout mode or a landscape layout mode. In book mode, the top of the page is the same edge of the media sheet for both the first side and the second side (e.g., as per a bound book). In tablet mode (e.g., portrait or landscape), the media sheet edge at the top of the first side corresponds to the bottom of the second side (e.g., as per a legal tablet).

For a media feed path which is parallel to the vertical axis of an image (e.g., conventional portrait mode printing), in one embodiment the printing system is constructed to print the second side of a media sheet opposite the orientation of the first side. For a media path which is perpendicular to the vertical axis of an image (e.g., conventional landscape printing mode), the same printing system print the second side of a media sheet with the orientation of the first side. For portrait printing in book mode, the software rotates the media image by 180° during second side printing to achieve a book format. For landscape printing in book mode, the software need not rotate the media image during second side printing to achieve book format. For portrait printing in tablet mode, the software need not rotate the media image during second side printing to achieve book format. For landscape printing in tablet mode, the software rotates the media image by 180° during second side printing to achieve a tablet format.

One advantage of the invention is that automatic media flipping and image rotation is accomplished without user intervention. These and other aspects and advantages of the invention will be better understood by reference to the following detailed description taken in conjunction with the accompanying drawings.

BRIEF DESCRIPTION OF THE DRAWINGS

FIG. 4 is a diagram of the duplex media handling system transmission and the simplex media handling system gear linkage of FIG. 3 according to one embodiment of this invention;

FIG. 5 is a diagram of the duplex media handling system and simplex media handing system during the pick and feed of a media sheet;

FIG. 6 is a diagram of the duplex media handling system and simplex media handing system at the completion of first side printing where the rollers are stopped with the media sheet trailing edge gripped by the metering rollers;

FIG. 11 is a diagram of a first side and a second side of a media sheet for printing in portrait mode;

FIG. 12 is a diagram of the second side of the media sheet of FIG. 11 receiving print recording in tablet format;

FIG. 13 is a diagram of the second side of the media sheet of FIG. 11 receiving print recording in book format;

FIG. 14 is a diagram of a first side and a second side of a media sheet for printing in landscape mode;

FIG. 15 is a diagram of the second side of the media sheet of FIG. 14 receiving print recording in tablet format; and FIG. 16 is a diagram of the second side of the media sheet of FIG. 14 receiving print recording in book format.

DESCRIPTION OF SPECIFIC EMBODIMENTS

Overview

Figure 1:
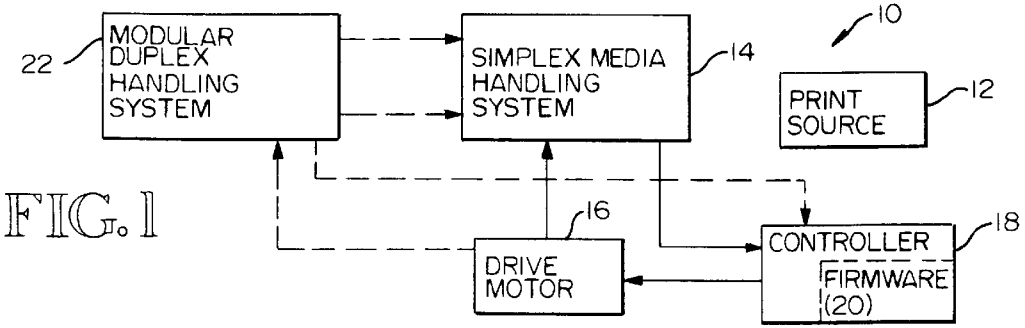
FIG. 1 is a block diagram of a print recording system according to an embodiment of this invention.

Referring to FIG. 1, a print recording system 10 includes a print source 12, a simplex media handling system 14, a drive motor 16 and a controller 18 with firmware 20. Also included in the system 10 is a modular duplex media handling system 22. The duplex media handling system 22 is removable, allowing the system 10 to be customized for simplex printing models and duplex printing models.

Figure 2:
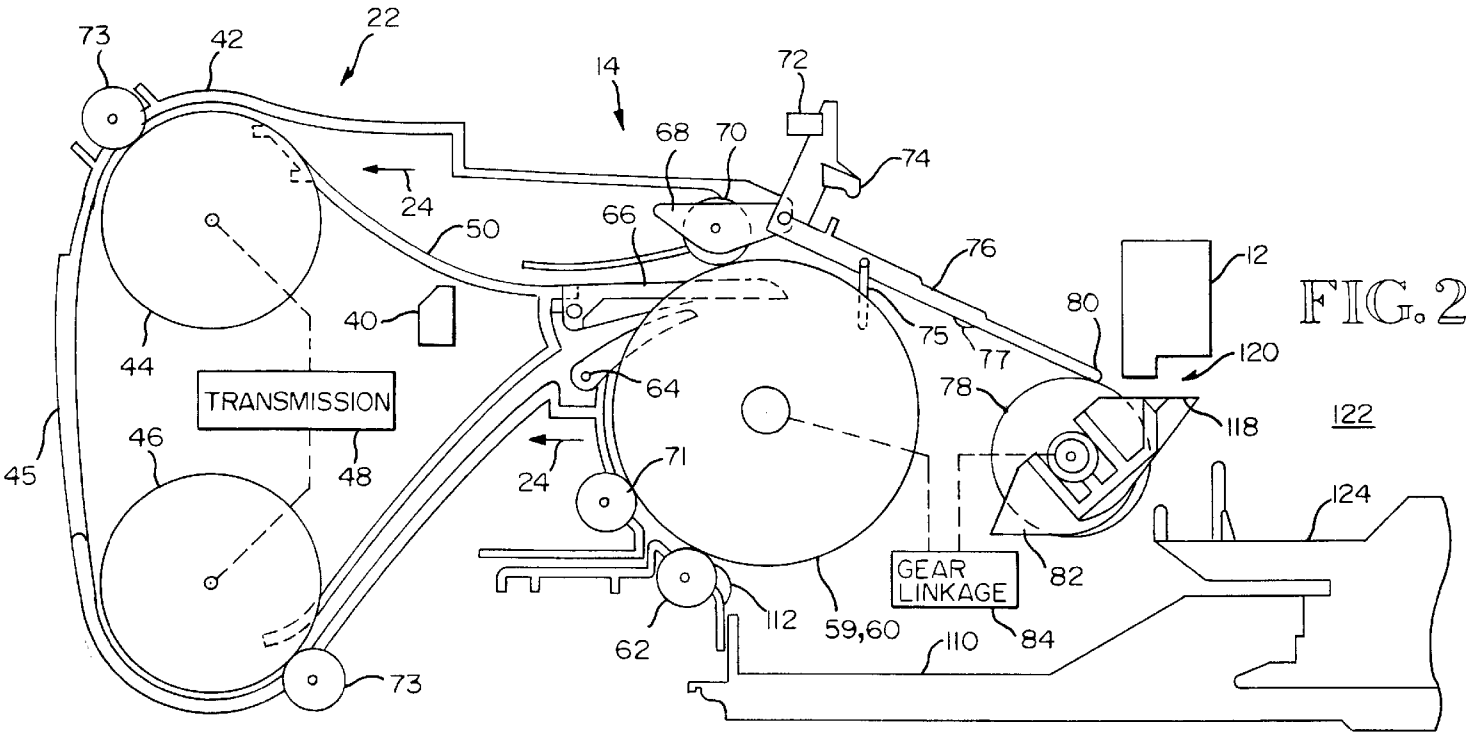
FIG. 2 is a planar view of a portion of the simplex media handling system and modular duplex handling system of FIG. 1 according to an embodiment of this invention.
Figure 3:
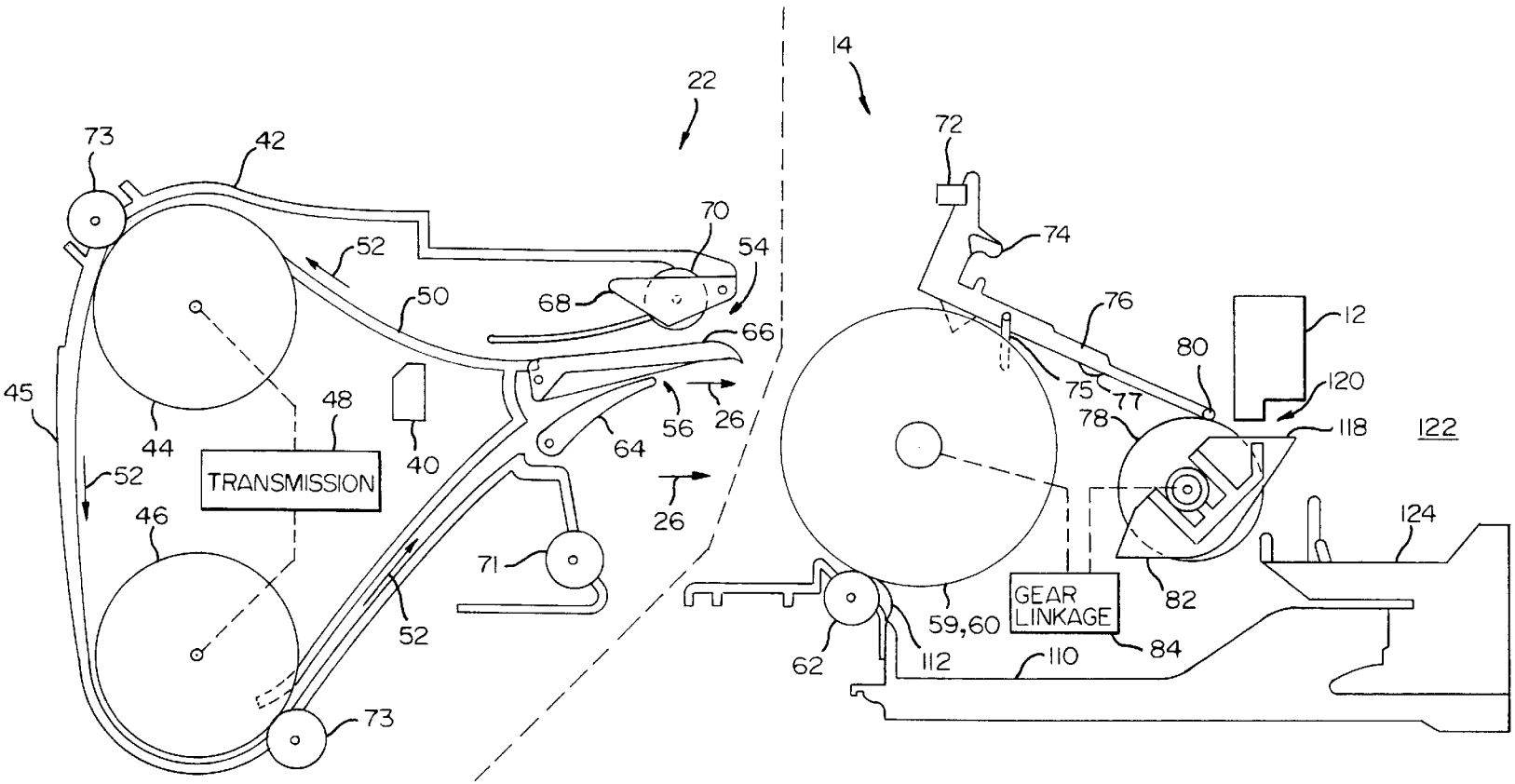
FIG. 3 is an exploded planar view of the duplex handling system separated from the simplex handling system of FIG. 2 according to an embodiment of this invention.

Referring to FIG. 2, the print source 12, simplex media handling system 14 and duplex media handling system 22 are shown for an inkjet printer embodiment. FIG. 3 shows the same structure with the duplex handling system 22 detached. The duplex media handling system 22 is easily removed by sliding the module 22 in direction 24 (see FIG. 2), then lifting the module away from the simplex media handling system 14. The duplex media handling system 22 is installed by removing a rear access door, then lowering the system 22 into a housing for the print recording system 10. The duplex media handling system 22 then is slid in direction 26 (see FIG. 3) toward the simplex media handling system 14. The duplex media handling system 22 engages to the simplex media handling system 14 using the same mechanical interface as was used for the removed rear access door.

The duplex media handling system 22 includes a sensor 40 which interfaces with the controller 18, allowing the controller 18 to detect whether the duplex media handling system 22 is present in the print recording system 10. An electrical, electro-mechanical and/or electro-optical connection is included to interface the sensor 40 output with the controller 18. The controller 18 tests to determine whether the duplex media handling system 22 is installed. Specifically, if a sensor 40 signal is present, then the system 22 is installed (since the sensor is part of the system 22). In response, the controller 18 firmware 20 (and host computing system software) enables both simplex printing and duplex printing operations. If a sensor 40 signal is not present, then the controller 18 firmware 20 (or host computing system software) disables duplex printing operations and allows simplex printing operations.

In operation the print recording system 10 receives a media sheet upon which text, graphics or other symbols are to be recorded. For example, in an inkjet printer embodiment the printer receives a print job from a host computing system (not shown). The controller 18 controls the drive motor 16 and print source 12 coordinating the movement of the media sheet relative to the print source 12. For single-sided (i.e., simplex) printing, the media sheet is fed through the simplex media handling system 14 adjacent to the print source 12 where the text, graphics or other symbols are recorded on the media sheet. For duplex printing, the media sheet is fed through the simplex media handling system 14 along a media path to perform first-side printing. The media sheet then is fed back along a portion of the media path into the duplex handling system 22 which flips the media sheet, then returns the media sheet to the simplex media handling system 14 for second side printing.

Referring to FIG. 3, the duplex media handling system 22 includes the sensor 40, a frame 42, panel 45, a pair of drive rollers 44, 46, a transmission 48, flip guides 64, 66, pinch rollers 70, 71, 73, and roller sleds 68. The transmission 48 is coupled to the print recording system's drive motor 16. During duplex printing, a media sheet is fed within the duplex media handling system 22 along a loop media path 52. The media sheet is received at flip guide 66 and fed by the simplex media handling system 14 along a paper guide 50 of the frame 42 toward the first drive roller 44. The drive roller 44 moves the media sheet along the path 52 to the second drive roller 46, which in turn, moves the media sheet out of the modular duplex handling system 22 back to the simplex media handling system 14. The duplex module media path 52 is a loop having an entry point 54 in the vicinity of the exit point 56. Both the entry point 54 and the exit point 56 are adjacent to a common area of the simplex media handling system 14.

Referring to FIGS. 2 and 3, the simplex media handling system 14 includes pick roller 59, feed rollers 60, feed idlers 62, media sensors 72, 77, flag 74, secondary flag 75, an upper guide 76, and metering rollers 78 with another set of pinch rollers 80, a pivot mechanism 82 and gear linkage 84. The drive motor 16 (see FIG. 1) is coupled to the feed rollers 60 and metering rollers 78 through the gear linkage 84. An opening is included for receiving the duplex media handling system 22.

Referring to FIG. 4, the gear linkage 84 of the simplex media handling system 14 is coupled to the transmission 48 of the duplex media handling system. The transmission 48 and gear linkage 84 couple the drive rollers 44, 46 to the drive motor 16. The transmission 48 includes a first drive gear 86 for the first drive roller 44 and a second drive gear 88 for the second drive roller 46. Through a subset of gears 86, 88, 91,92, 94, 95, and 100, the transmission 48 engages the drive rollers 44, 46.

Gear 100 serves as a coupling gear which links the transmission 48 to the gear linkage 84 of the simplex media handling system (e.g., at gear 102). Gear 100 is driven by the drive motor 16 through the gear linkage 84. Transmission gears 91, 92, and 94 are coupled to gear 100, and are mounted to a gear mount 89. The rotation of gear 100 causes the gears 91, 92 and 94 and gear mount 89 to move about the gear 100 in one of two directions 96, 98. Movement of the gears 91, 92, 94 in direction 96 brings gear 92 into engagement with gear 95, and gear 94 out of engagement with gear 95, causing drive gears 86, 88 to rotate in the opposite direction. In this engagement of gears 92 and 95, the transmission 48 is considered to be in first gear. Movement of the gears 91,92, 94 in direction 98 brings gear 94 into engagement with gear 95, and gear 92 out of engagement with gear 95, causing drive gears 86, 88 to rotate in one direction. In this engagement of gears 94 and 95, the transmission 48 is considered to be in second gear. In first gear, the drive rollers 44, 46 rotate in the same direction as the feed rollers 60 and metering rollers 78 of the simplex media handling system. In second gear, the drive rollers 44, 46 rotate in the opposite direction as the feed rollers 60 and metering rollers 78 of the simplex media handling system.

When the duplex media handling system is installed, gear 100 engages the gear linkage 84 of the simplex media handling system 14 at an interface gear 102. Gear linkage 84 also includes a drive gear 104 which is coupled to the drive motor 16 through a linkage included to drive the feed rollers 60 and metering rollers 78.

The transmission 48 also includes a clutch 90 which is coupled at one end to gear 94. The other end of the clutch 90 includes a protrusion 99 which moves within a cam track (not shown). When the transmission 48 is in neutral, the protrusion 99 sits in a fixed location (e.g., a V-lock groove) of the cam track. It takes a change of direction of gear 100 to move the protrusion out of the V-lock. A gear change (one of gears 92, 94 engaging gear 95) may then occur. Note that the clutch 90 moves with gear 94 in the directions 96,98. When gear 92 is engaged or gear 94 is engaged, the protrusion 99 does not come to rest in the V-lock. It is when the transmission 48 is in neutral, that the protrusion 99 sits in the V-lock.

To switch gears from engagement of gear 94 with gear 95 to neutral (the position illustrated in FIG. 4), the drive motor 16 stops driving gear 100, then restarts driving gear 100 in the opposite direction. This moves the gear 94 in direction 96 and brings the clutch 90 to rest in neutral (protrusion 99 sits in the V-lock). This is referred to as a stop and start action. To continue on switching gears to bring gear 92 into engagement with gear 95, the direction of gear 100 is changed again to allow the clutch 90 to come out of neutral, then the direction is changed one more time to move the gears 92, 94 and clutch 90 further along in direction 96. This brings gear 92 into engagement with gear 95. The actions to switch from neutral to engagement of gear 92 (or gear 94) with gear 95 is called a jogging action.

In a preferred embodiment the feed rollers 60 and metering rollers 78 are driven in a common direction during simplex or duplex media handling. That common direction changes during duplex printing, but is the same for the feed rollers 60 and metering rollers 78. Depending on the position of gears 92, 94, the drive rollers 44, 46, while engaged, rotate in either the same direction as the feed rollers 60/metering rollers 78 or in the opposite direction as the feed rollers 60/metering rollers 78. While the drive rollers 44,46 are engaged, one drive roller 44/46 always rotates in the same direction as the other drive roller 46/44. The specific gear linkages for the transmission 48 and linkage 84 may vary depending on the specific embodiment. For example the relative positioning and size of the simplex media handling system 14 and duplex media handling system 22 may vary, resulting in differing transmission 48 and linkage 84 embodiments.

Operation

The media handling operations for simplex and duplex media recording are described with regard to FIGS. 5–10. For either simplex or duplex print recording, a media sheet M is lifted into contact with a pick roller 59. The top sheet M is picked from a stack of media sheets in an input tray 110. Excess sheets are retarded by a restraint pad system 112 (see FIG. 2, 3). Referring to FIGS. 2 and 5 the picked media sheet M is fed around feed rollers 60. The feed idlers 62 and pinch rollers 70, 71 press the media sheet to the feed and pick rollers 59, 60. The media sheet pushes the flip guides 64, 66 out of the media path as the media sheet moves along the feed rollers 60. Beyond the flip guides 64, 66 the media sheet moves along a first media path 114. The media path 114 spans a path from rollers sleds 68/pinch rollers 70 to the metering rollers 78 and into a print zone 120. The media sheet is moved between the feed rollers 60 and the rollers sleds 68/pinch rollers 70, under the upper guide 76 and onto the metering rollers 78. Pinch rollers 80 press the media sheet to the metering rollers 78. Both the metering rollers 78 and the feed rollers 60 are moving in a forward direction 117 during the first side printing operation. Eventually a trailing edge of the media sheet M passes beyond the feed rollers 60 so that the metering rollers 78 move the media sheet. Beyond the pinch rollers 80, the media sheet is moved along a platform 118 of the pivot mechanism 82. The print source 12 is located adjacent to the platform 118. The area between the platform 118 and the print source 12 is referred to herein as the print zone 120. The media sheet M is fed through the print zone 120 into an output region 122, which in some embodiments includes an output tray 124.

For simplex printing, the media sheet is released into the output region 122. Immediately or after a suitable drying time (depending on the type of print source), another media sheet may be picked and fed along the media path through the print zone for print recording. For duplex printing, the above operation occurs for first side printing. However, for duplex printing the trailing edge 123 of the media sheet M is not released during the first-side printing. In some embodiments host computing system software signals the system 10 to perform a duplex operation with flipping of the media sheet.

Referring to FIG. 6, while the pinch roller 80 presses the trailing edge 123 of the media sheet M to the metering roller 78, the motion of the feed rollers 60 and metering rollers 78 ceases. A suitable drying time is allowed before the drive motor 16 reverses the rotational direction of the feed rollers 60 and metering rollers 78 to a direction 121 (see FIG. 7). The sensor 40, which also serves to indicate whether the duplex media handling system is installed, in one embodiment for a wet ink print recording system (e.g., inkjet print recording) is a humidity sensor. The sensor 40 detects the ambient humidity. Controller 18 in response to the detected humidity determines a sufficient drying time before allowing the media sheet to be moved for second side printing. In alternative embodiments separate sensors are used to determine humidity and whether the duplex media handling system is installed. In other embodiments, a sensor is not included for detecting drying time (e.g., non-wet ink printing; a worst case, or even a typical case, drying time is programmed in without sensory indication). Regardless of the sensor 40 embodiment, the controller 18 includes firmware programmed to handle simplex printing or duplex printing. The sensor 40 indication of whether the duplex media handling system is installed or not installed is used by the firmware to determine whether the duplex mode is available.

The determination of when to stop the metering rollers 78 with the media sheet trailing edge grasped is now described. The simplex media handling system 14 includes a media sensor 72 and flag 74 (see FIGS. 2 and 3). When the media sheet M is moved along the first media path 114 from the feed rollers 60 toward the metering rollers 78, the lead edge of the media sheet trips the flag 74. Once the trailing edge 123 passes beyond the flag, the flag 74 returns to its unbiased position. The sensor 72 indicates when the leading edge and trailing edge of the media sheet M have passed the flag 74.

These indications are detected by the controller 18 which then determines when the trailing edge 123 of the media sheet M is at the pinch roller 80. At such time the controller 18 has the drive motor 16 discontinue rotation of the feed rollers 60 and metering rollers 78. After a programmed pause (e.g., to allow for first side drying), the controller 18, then signals to the drive motor 16 to reverse the rotational directions of the feed rollers 60 and metering rollers 78 to the reverse direction 121.

Figure 7:
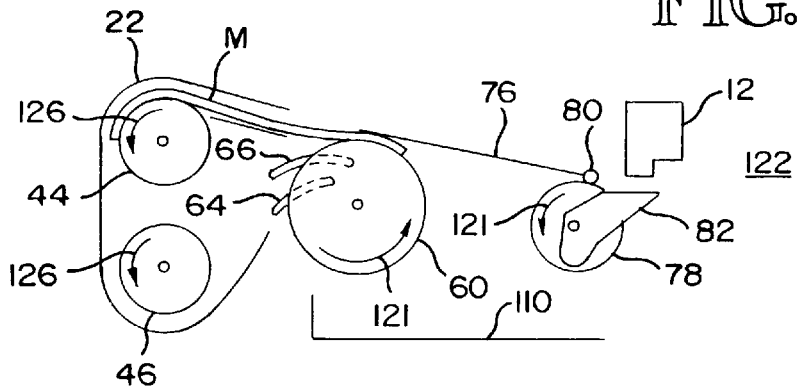
FIG. 7 is a diagram of the duplex media handling system and simplex media handing system where the media sheet is being fed back along the media path into the duplex media handling system.

Referring to FIG. 7, the metering rollers 78 feed the media sheet M back along the first media path 114 into contact with the feed rollers 60. The feed rollers 60 then continue feeding the media sheet back. Eventually the media sheet M is out of the grasp of the metering rollers 78 and fed back only by the feed rollers 60 (as distinguished from both the feed rollers 60 and metering rollers 78). As the media sheet M is fed back to and then onto the feed roller the flip guides 64, 66 are positioned in their unbiased position (see position in FIGS. 2 and 3). The unbiased position has the flip guides blocking the path around the feed rollers 60 back toward the input tray 110. Instead, the media sheet M is fed over a support surface of the flip guide 66 into the duplex media handling system module 22. The feed rollers 60 feed the media sheet M toward and onto the first drive roller 44. At the time where the controller 18 had the drive motor 16 reverse the directions of feed rollers 60 and metering rollers 78 to direction 121, such reversal action causes the transmission 48 to enter second gear (i.e., second gear 94 engages gear 95, see FIG. 4). As a result, when the media sheet is fed from the feed rollers 60 to the drive roller 44, the drive rollers 44, 46 are rotating in a direction 126. The drive roller 44 feeds the media sheet to drive roller 46. The drive rollers 44, 46, and then drive roller 46 alone feeds the media sheet along path 52 (see FIG. 3) back toward the feed rollers 60.

The duplex media handling system 22 has a media path length from entry point 54 to exit point 56 (see FIG. 3) which is at least as long as the maximum rated media sheet length for automatic duplex handling (e.g., 11 inches; 14 inches; 17 inches). If, however, automatic duplex handling is limited to a specific size, such as 11 inches or A4 paper length, then simplex printing (and manual duplex printing) may still print to larger sheets (e.g., 14 inches; 17 inches). Prior to the time the media sheet is fed out of the duplex media handling system 22 back onto the feed rollers 60, the feed rollers 60 are to change direction from reverse direction 121 back to the forward direction 117 . However, the direction through the duplex media handling system module should stay the same (i.e., direction 126) even when the feed rollers 60 go back to the forward rotational direction 117. The forward rotational direction as used herein refers to the direction 117 which the feed rollers 60 rotate to move the media sheet from the feed rollers 60 to the metering rollers 78 along the first media path 114.

Figure 8:
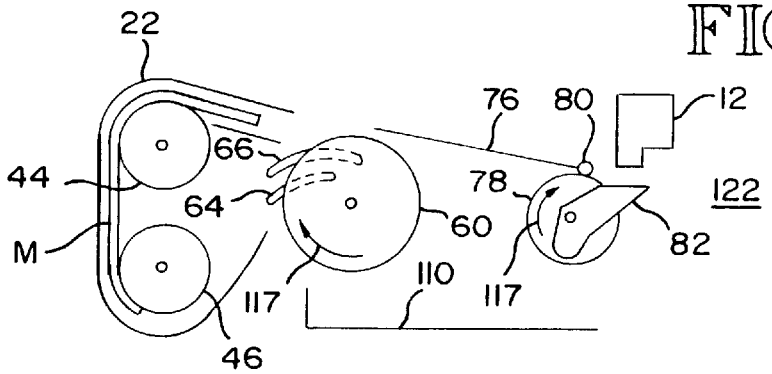
FIG. 8 is a diagram of the duplex media handling system and simplex media handing system where the media sheet is completely within the duplex media handling system and the feed rollers have reversed direction putting the transmission in neutral.
Figure 9:
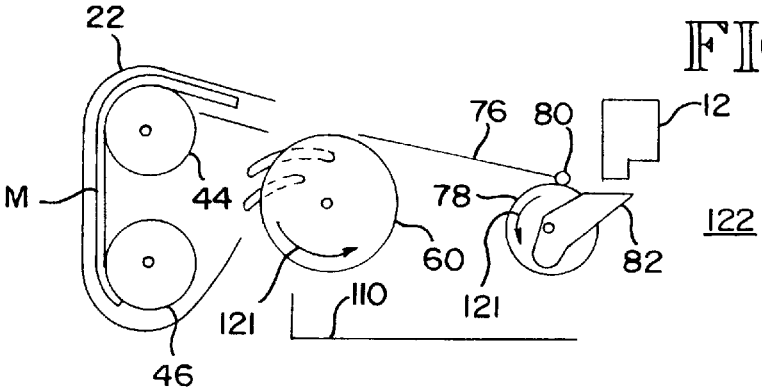
FIG. 9 is a diagram of the duplex media handling system and simplex media handing system during a jogging operation of the duplex media handling system transmission.

The process to change directions of the feed rollers 60 back to the forward direction 117, while the media sheet is in the duplex handling system 22, is now described. As the media sheet M is fed back along the first media path 114 from the metering rollers 78 to the feed rollers 60 (FIG. 7), the media sheet trips the secondary flag 75 which trips the flag 74 (see FIG. 3). The flag 74 is tripped, then released, as the entire media sheet passes beyond the flags 74, 75. The sensor 72 outputs such tripping indications to the controller 18. The controller knows what direction the drive motor 16 is rotating the rollers 60, 78, and thus knows that the media sheet is being fed back for duplex printing. Thus, the controller 18 knows what signification to give to the trippings of the flag 74. Once the media sheet M has passed completely beyond the flag 72, the controller 18 waits a prescribed time (based upon path length and feed speed) until the media sheet is off the feed rollers 60 and pinch rollers 71 and is driven/fed only by the drive rollers 44 (or both drive roller sets 44,46). In particular, the controller 18 waits until the media sheet is a prescribed distance beyond the feed roller into the duplex media handling system 22. At such time, the controller 18 signals the drive motor 16 to change the rotational direction of the feed rollers 60 and metering rollers 78 back to the original forward direction 117. FIG. 8 shows the media sheet M in the duplex media handling system 22 with the feed rollers 60 restarted in the opposite direction. This stopping and starting action of the feed rollers 60 (and metering rollers 78) moves the clutch 90 (see FIG. 4) causing the second gear 94 to come out of mesh. Specifically, the stopping and starting action puts the transmission 48 into neutral.

To shift the transmission 48 out of neutral, and more particularly to engage the first gear 92, rather than the second gear 94, a jogging action is performed. Shortly after the drive motor changes the direction of the feed rollers 60 back to the forward direction 117, the drive motor 16 changes the direction again back to the reverse direction 121 (see FIG. 9), then forward again to direction 117 (see FIG. 11). This operation is referred to herein as a jogging action. Such jogging action causes the transmission 48 to engage the first gear 92 with gear 95 (see FIG. 4). With the first gear 92 engaged while the feed rollers 60 rotate in the forward direction, the drive rollers 44, 46 rotate in the desired direction 126 (see FIG. 10).

The relationship of the transmission 48 to the drive roller directions is summarized below:

(1) When the second gear 94 of transmission 48 is engaged and the feed rollers 60 are rotating in the reverse direction 121, the drive rollers 44, 46 rotate in the desired direction 126 (see FIG. 7).

Figure 10:
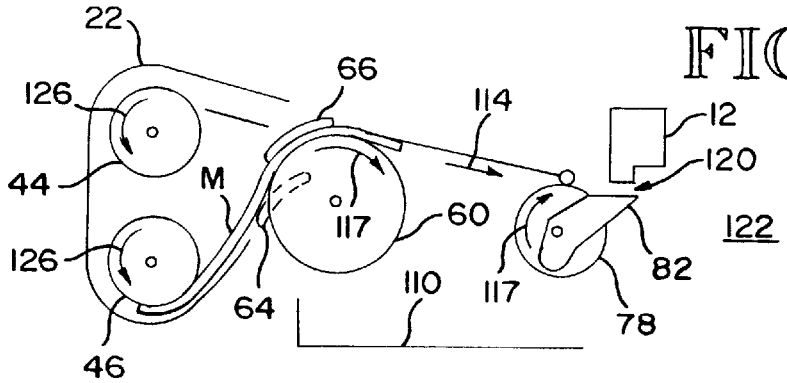
FIG. 10 is a diagram of the duplex media handling system and simplex media handing system during feeding of the media sheet from the duplex media handling system back to the simplex media handling system for second side print recording.

(2) When the first gear 92 of transmission 48 is engaged and the feed rollers 60 are rotating in the forward direction 117, the drive rollers 44, 46 rotate in the desired direction 126 (see FIG. 10).

Case 1 occurs initially when the media sheet is fed into the duplex media handling system module 22. Case 2 occurs after the jogging action allowing the media sheet M to be fed from the duplex media handling system 22 back onto the feed rollers 60. Case 2 is depicted by FIG. 10.

With the feed rollers 60 and metering rollers 78 rotating in direction 117 while the drive rollers 44, 46 rotating in direction 126, the media sheet M is fed out of the duplex media handling system 22 back onto the feed rollers 60. As a lead edge of the media sheet exits the duplex media handling system 22, such edge moves the flip guide 66 out of its path allowing the media sheet to be grasped by the feed rollers 60 and pinch rollers 71 and moved back onto the first media path 114 (see FIG. 10 and FIG. 5 for first media path 114). The media sheet M goes over the flip guide 64 and under the flip guide 66. The media sheet M is fed along the first media path 114 under the upper guide 76 for top of form sensing with sensor 72 and flags 74, 75, and onto the metering rollers 78 and the platform 118, into the print zone 120 for second side print recording. The media sheet M is fed through the print zone 120 into the output region 122. The media sheet then is released into the output region 122. Immediately or after a suitable drying time (depending on the type of print source), another media sheet may be picked and fed along the media path through the print zone for simplex or duplex print recording.

Image Rotation

In various embodiments, either firmware 20 of controller 18 or software from a host computing system to which system 10 is coupled, enables second side printing in either one of a book-format mode or a tablet-format mode. The mode is determined according to the print job of the host computing system being sent to the print recording system 10. Default mode may be either one of book-format mode or tablet-format mode, and may differ depending on whether printing in portrait mode or landscape mode.

FIGS. 11–13 relate to portrait printing mode. During first side printing, side 140 of media sheet M (see FIG. 11) receives print recording. During such first side printing, the media sheet M is fed through the print zone 120 (see FIG. 2) with edge 144 as the leading edge and edge 146 as the trailing edge. During second side printing, side 142 receives print recording. During such second side printing, the media sheet is fed through the print zone 120 with edge 146 as the leading edge and edge 144 as the trailing edge.

Referring to FIG. 12, in tablet-format mode, the media sheet edge 144 at the top of the first side 140 corresponds to the bottom of the second side 142 (e.g., as per a legal tablet). For the simplex handling system 14 and duplex handling system 22 shown in FIGS. 2 and 3, the image to be printed on the second side will normally print in tablet-format. If tablet-format mode is selected for the current print job, then such image is printed resulting in the tablet format shown in FIG. 12.

In book-format mode, the top of the page is the same edge 144 of the media sheet for both the first side 140 and the second side 142 (e.g., as per a bound book). Therefore when book-format mode is selected, the image is first rotated by 180° degrees before being printed onto the second side 142.

In the embodiment depicted in FIGS. 2 and 3, the printing system 10 is constructed to print the second side of a media sheet in tablet format during portrait printing. However, firmware 20 in one embodiment is implemented to have bookformat mode (e.g., rotating image 180°) be the default mode during portrait printing mode. In an alternative embodiment firmware 20 is implemented to have tablet-format mode be the default mode in portrait printing mode.

FIGS. 14–16 relate to landscape printing mode. During first side printing, side 150 of media sheet M' (see FIG. 14) receives print recording. During such first side printing, the media sheet M' is fed through the print zone 120 (see FIG. 2) with edge 154 as the leading edge and edge 156 as the trailing edge. During second side printing, side 152 receives print recording. During such second side printing, the media sheet is fed through the print zone 120 with edge 156 as the leading edge and edge 154 as the trailing edge. Media sheet edge 158 is located toward the top of the image. Media sheet edge 160 is located toward the bottom of the image.

For a book format in which the print is oriented in landscape mode, the top of the image for both sides 150, 152 are oriented toward the same edge 158. For a tablet format in which the print is oriented in landscape mode, the top of the image for side 150 is oriented to edge 158, while the top of the image for side 152 is oriented toward the opposite edge 160. FIG. 15 shows side 152 for tablet format in landscape printing. FIG. 16 shows side 152 for book format in landscape printing.

Because the lead edge during second side printing is edge 156 and the default top edge of the image is edge 158, In the embodiment depicted in FIGS. 2 and 3, the printing system 10 is constructed to have the lead edge be edge 156 during second side printing. Thus, unless the image is flipped, edge 158 will be toward the top of the image. This corresponds to the landscape mode, book format of FIG. 16. If book format mode and landscape printing mode are selected for the current print job, then such image is printed without flipping the image. If tablet format is desired, such as shown in FIG. 15, then the image is first rotated by 180° degrees before being printed onto the second side 152.

In the embodiment depicted in FIGS. 2 and 3, the printing system 10 is constructed to print the second side of a media sheet in book format during landscape printing. However, firmware 20 may be implemented to have either tablet format mode (e.g., rotating image 180°) or book format mode be the default mode during landscape printing mode.

Meritorious and Advantageous Effects

One advantage of the invention is that media flipping is provided without user intervention or reinsertion. Another advantage for wet ink printing is that first side media drying time may be assigned or estimated reducing the risk of wet image smear. Another advantage is that the duplex media handling system is a module which may be decoupled and removed. This allows for manufacturer customization of simplex and duplex print recording systems. Further, an end user also may remove and install the duplex media handling system module.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A method for printing to a first side, then to a second side, of a media sheet, the media sheet having a first edge and a second edge, the method comprising the steps of:

feeding the media sheet, with the media sheet first edge as a leading edge and the media sheet second edge as a trailing edge, along a first media path from a feed roller onto a metering roller and into a print zone for print recording onto a first side of the media sheet, as the media sheet moves through the print zone, stopping rotation of the metering roller while a trailing edge of the media sheet is gripped by the metering roller;

sensing that a duplex media handling module is installed, the duplex media handling module including a set of duplex media handling rollers;

while the trailing edge of the media sheet is gripped by the metering roller, reversing rotation of the metering roller;

moving the media sheet back along the first media path from the metering roller to the feed roller, feeding the media sheet from the feed roller onto the set of duplex media handling rollers;

moving the media sheet with the set of duplex media handling rollers along a loop media path, the media sheet departing contact with the feed roller during movement along the loop media path;

feeding the media sheet from the set of duplex media handling rollers back onto the feed roller with the media sheet second edge as the leading edge and the media sheet first edge as the trailing edge;

feeding the media sheet along the first media path from the feed roller onto the metering roller and into the print zone for print recording onto the second side of the media sheet; and rotating an image to be printed on the second side; and printing the rotated image onto the second side of the media sheet during the step of feeding the media sheet into the print zone for second side print recording.

2. The method of claim 1, in which the feed roller and the metering roller are linked to rotate in a common forward direction during print recording onto the first side of the media sheet and during print recording onto the second side of the media sheet, and in which the feed roller and the metering roller are linked to rotate in a common reverse direction during the steps of moving the media sheet back along the first media path from the metering roller to the feed roller, and feeding the media sheet from the feed roller onto the set of duplex media handling rollers.

3. A method for printing to a first side, then to a second side, of a media sheet, the media sheet having a first edge and a second edge, the method comprising the steps of:

feeding the media sheet, with the media sheet first edge as a leading edge and the media sheet second edge as a trailing edge, along a first media path from a feed roller onto a metering roller and into a print zone for print recording onto a first side of the media sheet;

as the media sheet moves through the print zone, stopping rotation of the metering roller while a trailing edge of the media sheet is gripped by the metering roller;

while the trailing edge of the media sheet is gripped by the metering roller, reversing rotation of the metering roller;

moving the media sheet back along the first media path from the metering roller to the feed roller;

feeding the media sheet from the feed roller onto a set of duplex media handling rollers, moving the media sheet with the set of duplex media handling rollers along a loop media path, the media sheet departing contact with the feed roller during movement along the loop media path;

feeding the media sheet from the set of duplex media handling rollers back onto the feed roller with the media sheet second edge as the leading edge and the media sheet first edge as the trailing edge;

feeding the media sheet along the first media path from the feed roller onto the metering roller and into the print zone for print recording onto the second side of the media sheet;

rotating an image to be printed on the second side;

printing the rotated image onto the second side of the media sheet during the step of feeding the media sheet into the print zone for second side print recording; and wherein the set of duplex media handling rollers are linked via a transmission to the feed roller, and further comprising, during the step of moving the media sheet with the set of duplex media handling rollers along the loop media path, the step of:

jogging the rotation of the feed roller from a reverse direction to a forward direction, back to the reverse direction and again to the forward direction while the media sheet is out of contact with the feed roller;

wherein during the step of jogging, the transmission is shifted into neutral to discontinue rotation of the set of duplex media handling rollers, then shifted into gear to rotate the set of duplex media handling rollers and move the media sheet further along the loop media path; wherein prior to the step of jogging the feed roller is rotating in the reverse direction while the set of duplex media handling rollers are rotating in a first direction and after the step of jogging the feed roller is rotating in the forward direction while the set of duplex media handling rollers are rotating again in the first direction.

4. A print recording apparatus for recording print onto a media sheet, comprising:

a print recording source;

a simplex media handling assembly for moving a media sheet along a media path into a print zone adjacent to the print recording source to receive print recording, the simplex media handling assembly comprising a feed roller;

a drive motor for driving rotation of the feed roller;

a removable duplex media handling module interfacing with the simplex media handling assembly to provide a media path for flipping the media sheet for second side printing; and a control apparatus for controlling movement of the media sheet and recording of print onto the media sheet, the control apparatus operating in either one of a book-format mode or a tablet-format mode, wherein in one of either the book-format mode or the tablet-format mode an image to be printed on one side of the media sheet is rotated prior to being printed;

wherein the duplex media handling module comprises a transmission for coupling a set of duplex handling drive rollers to the drive motor, the transmission having a neutral position, first position and a second position, wherein while the transmission is in the neutral position the set of duplex handling drive rollers are not engaged to rotate; wherein while the transmission is in the first position the set of duplex handling drive rollers are engaged to rotate in the same direction as the feed roller; and wherein while the transmission is in the second position the set of duplex handling drive rollers are engaged to rotate in the opposite direction as the feed roller.

5. The apparatus of claim 4, in which the control apparatus signals the drive motor to change motion of the feed roller and cause the transmission to change positions.

6. The apparatus of claim 5, in which the duplex media handling module includes a loop path for the media sheet, and in which the control apparatus allows the media sheet to travel only in one direction along the loop path.

7. The apparatus of claim 6, in which the loop path has a media sheet entry point and a media sheet exit point at the feed roller.

8. A control system for a printing operation, the control system interfacing with a print recording system having a drive motor, a feed roller and a metering roller, the control system controlling print recording onto a media sheet and movement of the media sheet, the media sheet having a first edge and a second edge, the control system comprising:

means for testing whether a duplex media handling module is installed in the print recording system;

means for disabling a duplex print recording mode of operation when the duplex media handling module is not installed;

means for enabling the duplex print recording mode of operation when the duplex media handling module is installed;

means for signalling the drive motor to rotate the feed roller and the metering roller in a forward direction to feed the media sheet, with the media sheet first edge as a leading edge and the media sheet second edge as a trailing edge, along a first media path from the feed roller onto the metering roller and into a print zone for print recording onto a first side of the media sheet;

means for signalling the drive motor, as the media sheet moves through the print zone, to stop rotation of the metering roller and feed roller while a trailing edge of the media sheet is gripped by the metering roller;

means for signalling the drive motor, during a duplex printing operation, while the trailing edge of the media sheet is gripped by the metering roller, to reverse rotation of the metering roller and feed roller into a reverse direction and to engage a transmission of the duplex media handling module into a gear which causes rotation of a set of duplex media handling rollers in a first direction, the media sheet being moved back along the first media path onto the set of duplex media handling rollers; and means for rotating an image to be printed on one side of the media sheet to print record in one of either book-format mode or tablet-format mode.

9. The control system of claim 8, further comprising:

means for signalling the drive motor, during a duplex printing operation, to jog the rotation of the feed roller and the metering roller from the reverse direction to the forward direction, back to the reverse direction and again to the forward direction while the media sheet is out of contact with the feed roller, wherein during the jog, the transmission is shifted into neutral to discontinue rotation of the set of duplex media handling rollers, then shifted out of neutral to rotate the set of duplex media handling rollers and move the media sheet further along a loop path within the duplex media handling module, and wherein prior to the jog the feed roller is rotating in the reverse direction while the set of duplex media handling rollers are rotating in the first direction and after the jog the feed roller is rotating in the forward direction while the set of duplex media handling rollers are rotating again in the first direction to allow the media sheet to be fed along the first media path for second side printing.

* * * * *